US006357797B1

(12) United States Patent
Lee

(10) Patent No.: US 6,357,797 B1
(45) Date of Patent: Mar. 19, 2002

(54) BOOK COVER

(76) Inventor: Chun-Yang Lee, 9F, No. 405, Thung Gan 5 St., Guai Shan Hsiang, Taoyuan Hsien (TW)

( * ) Notice: Subject to any disclaimer, the term of this patent is extended or adjusted under 35 U.S.C. 154(b) by 0 days.

(21) Appl. No.: 09/743,961

(22) PCT Filed: Jul. 22, 1999

(86) PCT No.: PCT/CN99/00098

§ 371 Date: Jan. 18, 2001

§ 102(e) Date: Jan. 18, 2001

(87) PCT Pub. No.: WO00/07824

PCT Pub. Date: Feb. 17, 2000

(30) Foreign Application Priority Data

Jul. 31, 1998 (CN) ..... 98207399 U

(51) Int. Cl.[7] ..... B42D 9/00

(52) U.S. Cl. ..... 281/42; 281/20; 281/19.1; 402/80 R; 283/37; 283/39

(58) Field of Search ..... 281/15.1, 19.1, 281/17, 19.2, 20, 29, 37, 34; 402/70, 73, 79; D19/26

(56) References Cited

U.S. PATENT DOCUMENTS 4,412,692 A * 11/1983 Williams ..... 281/34
D295,290 S * 4/1988 Klang ..... D19/26
5,853,259 A * 12/1998 Murry, Jr. ..... 402/79 X
5,904,374 A * 5/1999 Lee ..... 281/29

* cited by examiner

*Primary Examiner*—Willmon Fridie, Jr.
(74) *Attorney, Agent, or Firm*—Rosenberg, Klein & Lee

(57) ABSTRACT

A cover apparatus for a book is provided. The cover apparatus includes a body portion that defines a substantially plainer protecting surface which attaches to an inner page of a book. The cover apparatus also includes a folding piece portion extending laterally to the body portion. The folding piece portion is formed with a plurality of laterally extending folding piece strips which are separably disposed one relative to the other in substantially parallel manner. The folding piece portion has formed thereon a plurality of longitudinally extending folding lines such that each folding piece strip may be bent along at least a portion of one folding line.

5 Claims, 4 Drawing Sheets

BOOK COVER

FIELD OF THE INVENTION

The present invention relates to a book cover, and especially to a book cover which can protect a page of a book from oxidation and dust, and which provides an integral bookmark.

BACKGROUND OF THE INVENTION

A single page book cover adhered to the surface layer of a book is known. Such book cover includes a protecting surface having a size identical to that of the book and aligning with its edges (front, upper, and lower edges). The cover is extended with a folding piece that is bendable into the book so as to yield an integrally formed book cover, which has the function of dust-proofing and protecting the unbound edge of a book. However, in the prior art, the single folding piece of the book cover can only enable one important note to be recorded. It does not enable more such important notes to be recorded. Therefore, the use of such book cover is not convenient. Furthermore, such prior art book covers are inconvenient to machine, thus requiring the cover to be improved.

SUMMARY OF THE INVENTION

Therefore, the object of the present invention is to provide a book cover which is convenient to machine and convenient to use and record important notes with. Moreover, the book cover can be made as a bookmark.

There is provided a book cover having a protecting surface and a folding piece extending from at least one lateral side thereof. The surface of the folding piece is formed with a plurality of parallel and equally spaced folding lines. One end of the book cover is fixed to an inner page of the book so as not to drop out.

BRIEF DESCRIPTION OF THE DRAWINGS

The various objects and advantages of the present invention will be more readily understood from the following detailed description when read in conjunction with the appended drawings.

DETAILED DESCRIPTION OF THE PREFERRED EMBODIMENTS

Figure 1:
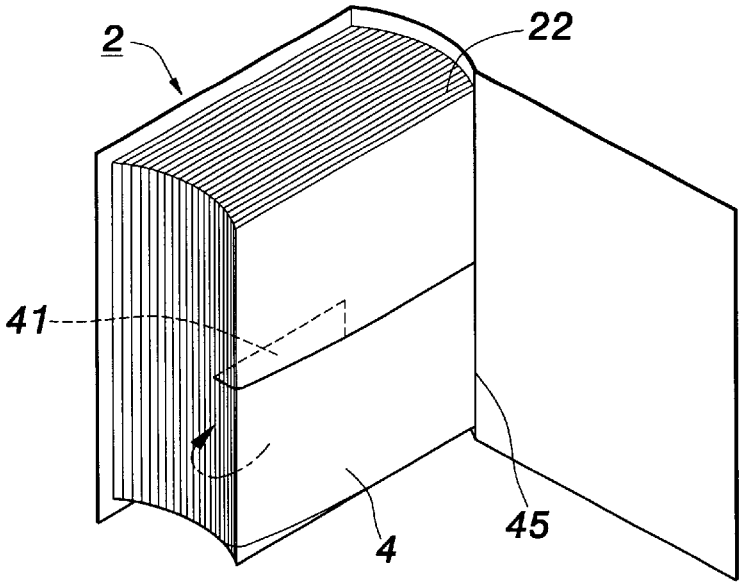
FIG. 1 shows an embodiment of a single page book cover of the present invention applied to a book.
Figure 2:
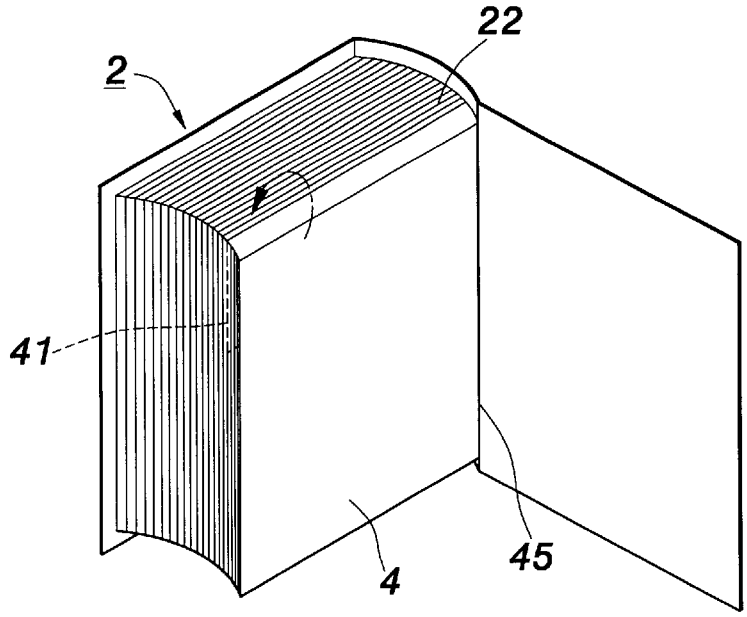
FIG. 2 shows another embodiment of a single page book cover applied to a book.

With reference to FIGS. 1 and 2, a single page book cover 4 is shown appended to the surface of the inner page 22 of the book 2. The size and shape of the single page book cover 4 is not confined to that shown. One lateral side 45 of the single page book cover 4 is bound with the binding side of the book 2. This binding work can be performed before the book is commercially sold by a binding manufacturer, since each book 2 needs to be bound with a binding edge. By such pre-binding with the book, the single page book cover 4 can be attached to the book, obviating the need for a user to effect such attachment. Furthermore, such pre-binding will yield a stronger fastening of the single page book cover 4 to the book.

Figure 3:
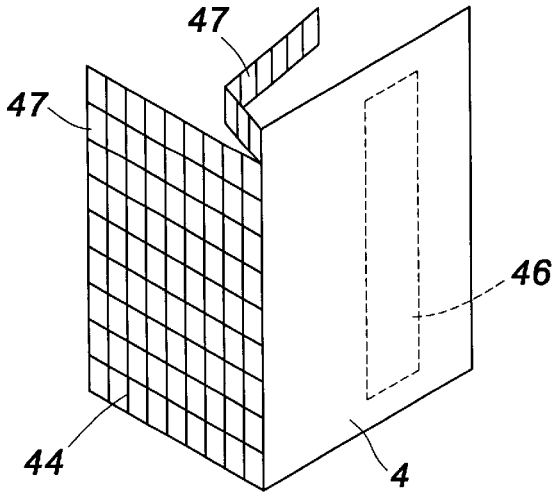
FIG. 3 is a perspective view of another embodiment of the present invention.
Figure 4:
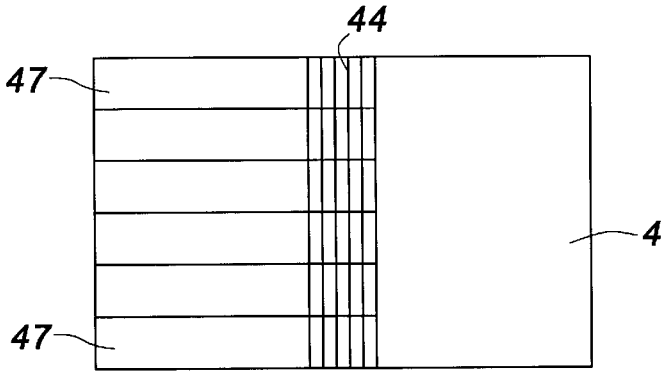
FIG. 4 is a plan view of another embodiment of the present invention.
Figure 5:
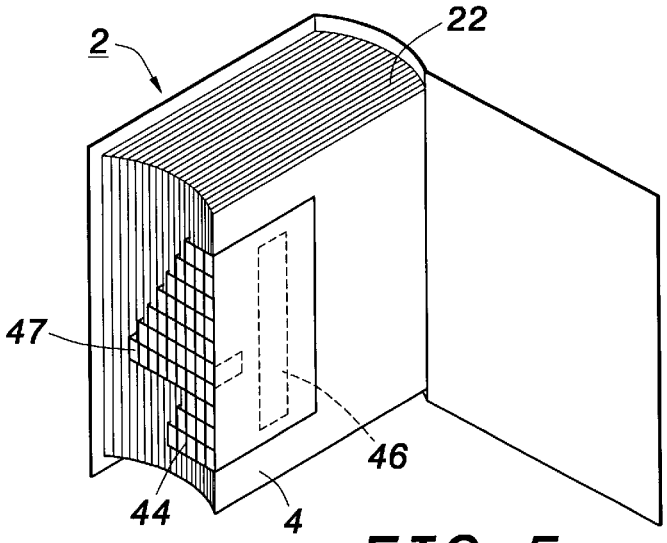
FIG. 5 shows an application example of the present invention.

In FIG. 3, one surface of the single page book cover 4 can be provided with at least one strip of tape 46 that adheres it to the surface of the inner page 22 of the book 2. In addition to forming a plurality of folding lines 44, a plurality of small folding pieces 47 separable one from the other may be defined. The configuration of each small folding piece 47 may be determined as desired. For example, the single page book cover 4 shown in FIG. 4 has longer and wider small folding pieces 47, while the fold lines 44 are fewer and closer together. When the single page book cover 4 is adhered to the inner page (see FIG. 5), a plurality of small folding pieces 47 can be respectively inserted into the book according to the requirements of the user. Therefore, a plurality of important notes and abstracts can be marked or tabbed for reference afterwards. The aforesaid folding pieces 47 are formed and situated to extend from a front edge of the single page book cover 4. Similarly, they can be formed and situated to extend from an upper or a lower edge of the single page book cover 4.

Figure 6:
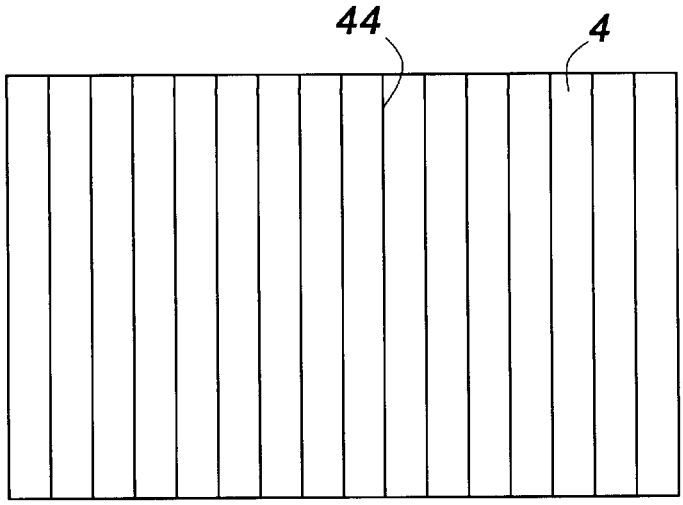
FIG. 6 is a plan view of yet another embodiment of the single page book cover of the present invention.
Figure 7:
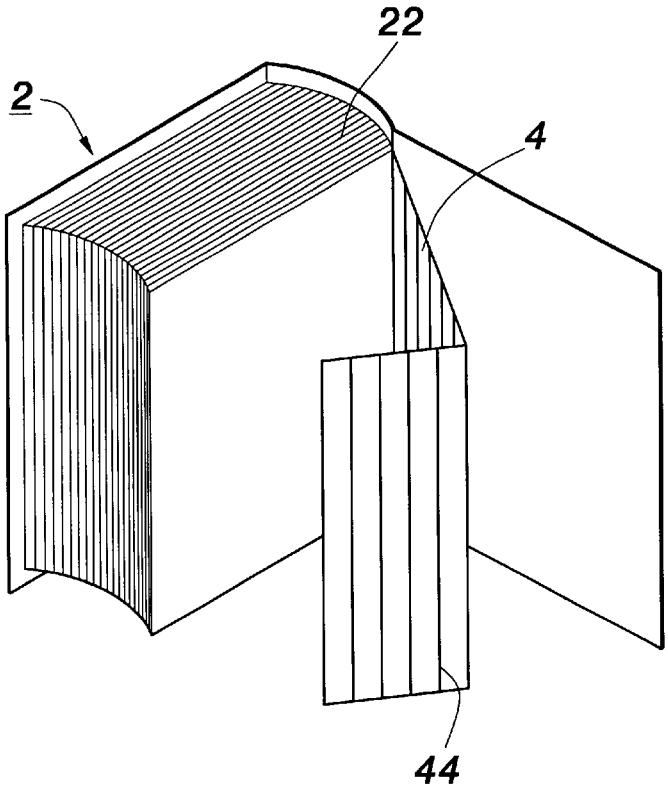
FIG. 7 is an example of binding with a book the book cover of FIG. 6.

The single page book cover 4 shown in FIG. 6 is formed with folding lines distributed across its entirety. Therefore, other than the front folding piece 41 having folding lines 44, the body 40 of the single page book cover 4 also has folding lines 44 formed thereon. This permits folding lines to be rapidly formed before the cover is adhered to the inner page 22 of a book (referring to FIG. 7). Also, this configuration permits the manufacturing process to be speeded up.

Figure 8:
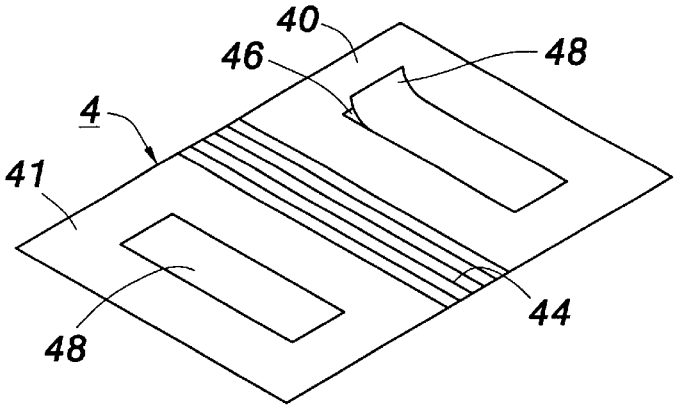
FIG. 8 is a perspective view showing another embodiment of the present invention.
Figure 9:
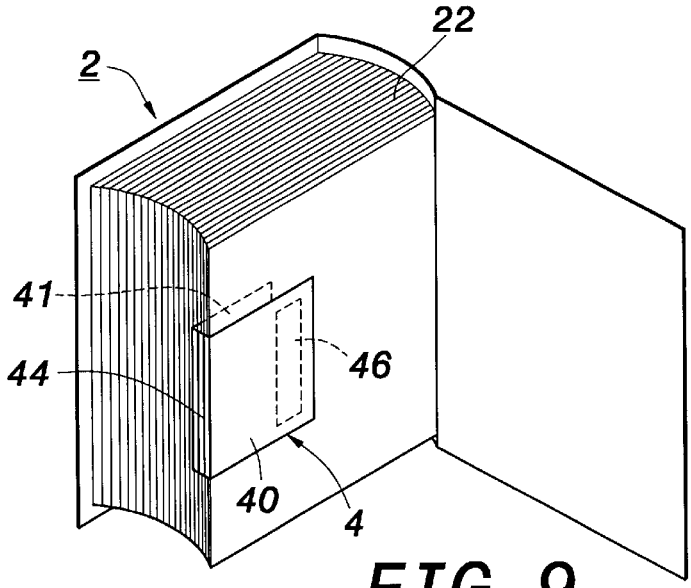
FIG. 9 is a perspective view of an embodiment of the present invention as applied to a book.
Figure 10:
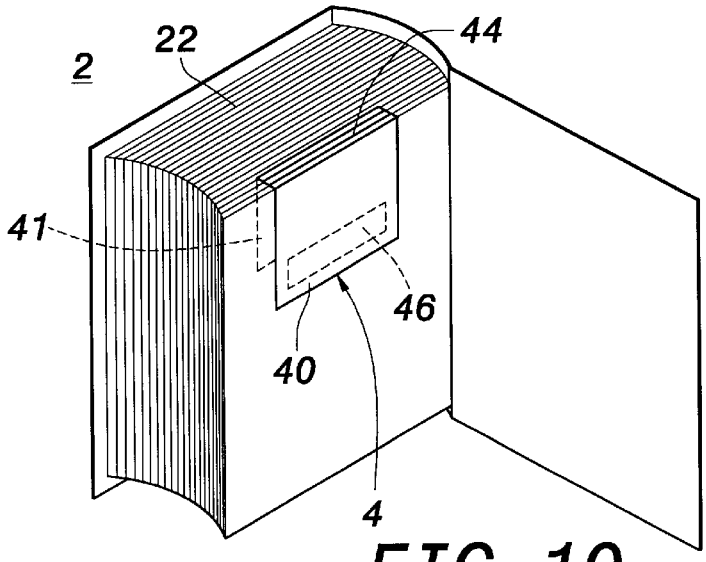
FIG. 10 is another perspective view of an embodiment of the present invention as applied to a book.

Referring to FIG. 8, a book cover 4 formed by two pieces of paper connected one to the other is shown. One of the paper pieces forms the body 40 of the book cover, and the other forms a folding piece 41. A folding line section 44 is formed between the two pieces of paper. Since they are formed of the same material, either piece can be tightly adhered to the inner page 22 of the book. Preferably, the surfaces of the two paper pieces 40, 41 have adhered thereto strips of tape 46. The surfaces of the tape strips 46 are covered by separable paper 48 so that the user may freely select and control the manner in which one of the paper pieces 40 (or 41) is adhered to the inner page 22 of the book in a given application. FIGS. 9 and 10 show alternative ways in which a user may adhere the single page book cover 4 to a book.

An advantage of the present invention is that the folding piece can be divided into a plurality of smaller folding pieces such that numerous important notes and abstracts can be respectively recorded and further, that the folding lines on the surface of the book cover can be easily made.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A cover apparatus for a book comprising:

(a) a body portion defining a substantially planar protecting surface for attachment to an inner page portion of the book; and, (b) a folding piece portion extending laterally from said body portion, said folding piece portion including a plurality of adjacent laterally extending folding piece strips separably disposed one relative to the others in substantially parallel manner, said folding piece portion having formed thereon a plurality of longitudinally extending folding lines laterally spaced one from the others, said folding piece strips each being independently bendable along at least a portion of one said folding line.

2. The cover apparatus as recited in claim 1 further comprising adhesive means for adhering said protecting surface of said body portion to the inner page of the book.

3. The cover apparatus as recited in claim 1 wherein said body portion includes at least one adhesive tape strip coupled to said protecting surface for adhesion to the inner page of the book.

4. The cover apparatus as recited in claim 1 wherein said body portion includes an edge bindable with a binding of the book.

5. The cover apparatus as recited in claim 1, 2, 3, or 4 wherein said body portion has formed thereon a plurality of said folding lines.

* * * * *